US005862770A

United States Patent [19]

Aavitsland

[11] Patent Number: 5,862,770

[45] Date of Patent: Jan. 26, 1999

[54] SEA-BASED TRANSPORTATION AND LOAD HANDLING SYSTEM

[76] Inventor: Dag O. Aavitsland, Terrasseveien 6, N-1320 Stabekk, Norway

[21] Appl. No.: 817,293

[22] PCT Filed: Oct. 17, 1995

[86] PCT No.: PCT/NO95/00190

§ 371 Date: Apr. 7, 1997

§ 102(e) Date: Apr. 7, 1997

[87] PCT Pub. No.: WO96/11838

PCT Pub. Date: Apr. 25, 1996

[30] Foreign Application Priority Data

Oct. 18, 1994 [NO] Norway ..... 943951

[51] Int. Cl.[6] ..... B63B 35/40

[52] U.S. Cl. ..... 114/260; 114/61

[58] Field of Search ..... 114/258–260, 263, 114/61, 248

[56] References Cited

U.S. PATENT DOCUMENTS 3,537,413 11/1970 Farrell ..... 114/260

4,135,468 1/1979 Kirby et al. ..... 114/260

*Primary Examiner*—Jesus D. Sotelo

*Attorney, Agent, or Firm*—Kane, Dalsimer, Sullivan, Kurucz, Levy, Eisele and Richard, LLP

[57] ABSTRACT

Sea-based transportation and load handling system, comprising a ship of the catamaran type, having two hulls being arranged at a distance from each other and a deck (4) connecting the upper portions of the hulls, where the hull sides of the hulls are facing each other and being adapted for moving a load unit (2) in between the hulls, the load unit (2) substantially occupying the space between the hulls, and couplings (5) being arranged in the sides of the load unit (2) and in the hull sides to ensure interconnection of a load unit (2) with the two hulls of the catamaran.

7 Claims, 1 Drawing Sheet

SEA-BASED TRANSPORTATION AND LOAD HANDLING SYSTEM

The present invention is related to a sea-based transportation and load handling system, according to the preamble of the claims.

Sea transport of large load volumes, especially long distance transportations, have substantial advantages above other transportation possibilities. Within bulk, general cargo and tank transportation many and large efforts have been made to minimize the harbour time for the ships during loading and unloading. The capacity of the different harbours also to a high extent decide the harbour time for the ships, the length of the quay as well as the land based cranes used by the ships.

In many cases transportation is performed as total ship loads from one place to another, in other cases parts of the load are loaded or unloaded in different harbours. In both cases the ship, with its transportation capability rests and is not used in periods of loading and unloading. Even if the harbour time is utilized also for bunkering, maintenance and repairs, the harbour time is much longer than needed for such operations, due to the time for loading and unloading.

Different systems have been developed for acceleration of loading and unloading operations, such as large quick operating cranes, advanced container cranes and other load handling systems.

With the system according to the present invention, the harbour time for ships is substantially decreased for loading and unloading as loading and unloading are performed before and after the ship visits a harbour. These advantages are achieved with the transportation system according to the present invention.

With the transportation and load handling system according to the present invention, a possibility is provided to execute loading and unloading when the need exists or when the capacity for loading and unloading is present. The system is very flexible as to the type of load and in relation to arrival and departure times for ships as the load units according to the system is waiting to be transported, the loading is completed, or opposite, the units may wait until unloading is made. The system can be utilized for which ever type of load, such as gas, oil, bulk or cargo.

BRIEF DESCRIPTION OF THE DRAWINGS

The drawing discloses in FIG. 1 schematically a cross section of a ship constructed according to the transportation system of the present invention, FIG. 2 discloses a vertical longitudinal section of the ship in FIG. 1 and FIG. 3 discloses an example for utilization of the transportation system according to the present invention, adapted for oil transport.

DETAILED DESCRIPTION OF THE DRAWINGS

Figure 1:
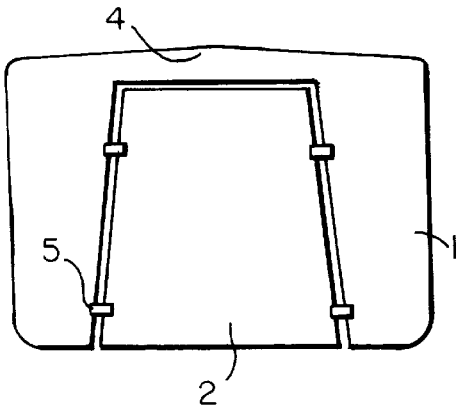
Figure 2:
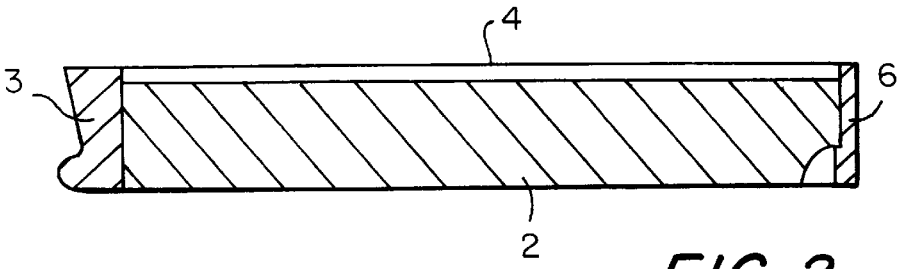

The principle of the transportation system is disclosed, especially in FIGS. 1 and 2. A ship hull 1 of the catamaran type has adapted the opening between the two hulls for receipt of a load unit 2. The two hulls of the catamaran are connected with each other at the uppermost area with a deck 4 on which the superstructure of the ship is arranged, however not disclosed in the drawing.

The load unit 2 and the catamaran 1 are interconnected by lifting the catamaran so much by means of the ballast system of the catamaran, that the load unit 2 can be floated into the room between the two hulls of the catamaran 1, whereafter the catamaran 1 is lowered onto the load unit 2.

The load unit 2 substantially fills out the open space between the two hulls of the catamaran 1 and is connected with the hulls of the catamaran by means of correspondingly adapted connections 5 which may be designed based on suitable principles and remote controlled from the ship bridge.

The catamaran 1 is provided with a bow 3 which is common for both hulls and cover the open space between the hulls, respectively cover the hulls and the load unit 2. The bow 3 is removed from the bow portion of the catamaran for the purpose of manoeuvring the load unit 2 in or out of the space between the catamaran hulls. Preferably the bow 3 is tiltable as disclosed in FIG. 3, thereby to push or pull the load unit 2 in or out of the space. Even the bow 3 is secured to the catamaran 1 and the load unit 2 in a suitable way by means of couplings not disclosed in the drawing.

Preferably a stern 6 connects two hulls, especially for large scale catamarans 1. The stern 6 thereby covers the stern of the load unit 1 and in all cases part of the two hulls and provides the catamaran 1 with the necessary rigidity.

The load unit 2 also can be provided with ballast tanks as an independent unit. When the load unit 2 is to be moved into the hull of the catamaran, the load unit 2 thereby can use its ballast system in cooperation with the ballast system of the catamaran, in such a way that the load unit can be moved into the hull of the catamaran and by means of the ballast systems can be connected to each other by means of couplings 5, whereafter the bow 3 is tilted into place and likewise locked with couplings.

Serious demands are connected with the couplings 5 which may be constructed based on different principles. The couplings 5, however, must connect the hulls and the load unit to one unit in such a way that during transport this unit substantially has the same properties as a ship with only one hull. This is achieved with coupling units which can be basicly mechanical, hydraulic, pneumatic, electromagnetic, electric, electronic or such or combinations of such.

The load unit 2 can be arranged or parked suitably for receipt of different types of load. By means of a special load ramp or trap door the load unit 2 may be arranged at a quay by means of suitable connections and the load unit thereby can be utilized for loading and unloading according to the row-row-principle and to be loaded and unloaded independently of the arrival and departure times for the catamaran. The load unit 1 furthermore also very easy may receive cars and other vehicles for operation as a ferry by arranging the load unit at a quay with a trap door corresponding to the row-row-solution.

Figure 3:
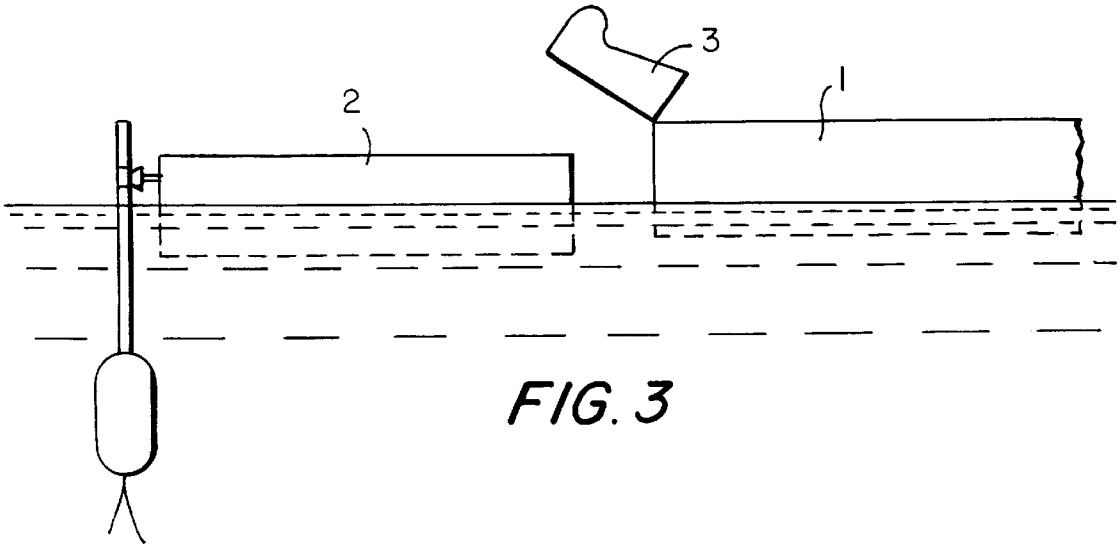

FIG. 3 discloses schematically the transportation system adapted for offshore oil transportation. A load unit 2 is moored to a buoy or another type oil transfer unit and is collected when the load unit is full. The load unit 2 is brought into the hull opening of the catamaran 1 by means of the ballast systems of the catamaran and possibly of the load unit.

Ventilation plant, cooling plants and other may be arranged on the deck 4 of the catamaran, preferably as modules. These are connected with the load unit in a suitable way when the load unit is firmly connected to the catamaran by means of the couplings 5. In this way very easily the type of the load may be considered as well as the security, such as for example ventilation or cooling during transportation of oil, gas etc.

The transportation system especially is well suited for bulk transport and oil transport, but also in relation to known techniques or cargo, container transport, ferry operation and general cost line operation, the present invention has many advantages.

Load units 2 can be moored for loading and/or unloading whereby catamarans 1 collects and bring other units to the same harbour, depending on the situation.

I claim:

1. Sea-based transportation and load handling system, comprising a ship of the catamaran type, having two hulls being arranged at a distance from each other and a deck (4) connecting the upper portions of the hulls, and having a bow (3) and a stern (6), characterized in the hull sides of the hulls facing each other being adapted for moving a single load unit (2) in between the hulls at said bow (3) of said ship, the load unit (2) substantially occupying the space between the hulls, and couplings (5) being arranged in the sides of the load unit (2) and in the hull sides to ensure interconnection of a load unit (2) with the two hulls of the catamaran, said hulls and said load unit (2) thereby being joined into a sea-going unit having substantially the same properties as a ship having a single hull.

2. System according to the preceding claim, CHARACTERIZED IN the stern of the two hulls being connected with the common stern (6) covering the space between the hulls.

3. System according to claim 1, CHARACTERIZED IN a common bow (3) covering the two hulls and the space between the two hulls and being adapted to be removable at least from the space between the hulls, thereby allowing transportation in and out of a load unit (2) from the space.

4. System according to claim 3, CHARACTERIZED IN the bow (3) being adapted to be tilted up around an axis near the deck (4), being horizontal and perpendicular to the longitudinal axis of the ship.

5. System according to claim 1, CHARACTERIZED IN suitable connection being adapted to lock the load unit (2) to the bow (3) and possibly to the stern (6) in such a way that one single seaborne unit is established.

6. System according to claim 1, CHARACTERIZED IN the load unit (2) being provided with a separate ballast system.

7. System according to claim 6, characterized in said separate ballast system being remote controlled from said ship.

* * * * *